United States Patent [19]

Mertz

[11] Patent Number: 4,531,172

[45] Date of Patent: Jul. 23, 1985

[54] ELECTRIC CIRCUIT BREAKER WITH A REMOTE CONTROLLED STATIC SWITCH

[75] Inventor: Jean-Luc Mertz, Grenoble, France

[73] Assignee: Merlin Gerin, France

[21] Appl. No.: 528,982

[22] Filed: Sep. 2, 1983

[30] Foreign Application Priority Data

Sep. 17, 1982 [FR] France ..... 82 15841

[51] Int. Cl.[3] ..... H01H 73/18

[52] U.S. Cl. ..... 361/13; 335/6; 361/115

[58] Field of Search ..... 361/7, 8, 13, 115, 163, 361/189, 190; 335/156, 159, 162, 6

[56] References Cited

U.S. PATENT DOCUMENTS 3,430,016 2/1969 Hurtle ..... 361/13 X
3,466,503 9/1969 Goldberg ..... 361/13 X
4,272,687 6/1981 Borkan .

FOREIGN PATENT DOCUMENTS 2344949 10/1977 France .
2360977 3/1978 France .

*Primary Examiner*—Harry E. Moose, Jr.
*Attorney, Agent, or Firm*—Parkhurst & Oliff

[57] ABSTRACT

The invention relates to a miniature circuit breaker having remote control capabilities.

The protection function of the circuit breaker is ensured by a magnetothermal release cooperating with an operating mechanism to induce the opening of contacts. The remote control function of the circuit breaker results from the presence of a triac connected in series with the contacts and the release. The creation or breaking of the rated current occurs by conducting or locking the triac without activating the mechanism. The triac is automatically short-circuited when the arc is switched on a lower horn during the cut-off phase following the appearance of a fault current detected by the release.

7 Claims, 3 Drawing Figures

ELECTRIC CIRCUIT BREAKER WITH A REMOTE CONTROLLED STATIC SWITCH

BACKGROUND AND SUMMARY OF THE INVENTION

The invention relates to an electric circuit breaker having a remote controlled static switch rated to carry and to break the load current.

A circuit breaker is generally equipped with a manual control handle for opening and closing and is capable to interrupt fault currents automatically. It does not readily permit the use of a remote control and its mechanism is not adapted to a great number of operations.

An object of the present invention is to remedy to these disadvantages and to permit the realization of a circuit breaker with simple and inexpensive remote control. In accordance with the invention, a static switch, in particular a triac, ensures the remote control, the circuit breaker mechanism and its contacts playing no role in this operation. The properties and advantages of static switches are well known but the possibilities for using them are limited by their high sensitivity to overloads which induce their destruction. It was already proposed in U.S. Pat. No. 4,272,687 to associate a static switch and a circuit breaker, the protection on fault, especially on short-circuit, being ensured by the circuit breaker, whereas the static switch permits a remote control. The response time of this known circuit breaker is too long to effectively protect the semi-conductor of the static switch and this circuit breaker cannot be used in distribution circuits. According to the invention, by using the arc switching to shunt the semiconductor the circuit breaker protects the semi-conductor at the same time. The assembly can be placed in a common casing of standard dimension, which makes the connections and the mounting easier. The circuit breaker can be unipolar or multipolar, in particular for alternating current.

BRIEF DESCRIPTION OF THE DRAWINGS

Other advantages and technical data will more clearly appear from the following description, wherein reference is made to the accompanying drawings, in which.

DETAILED DESCRIPTION OF THE PREFERRED EMBODIMENTS

Figure 1:
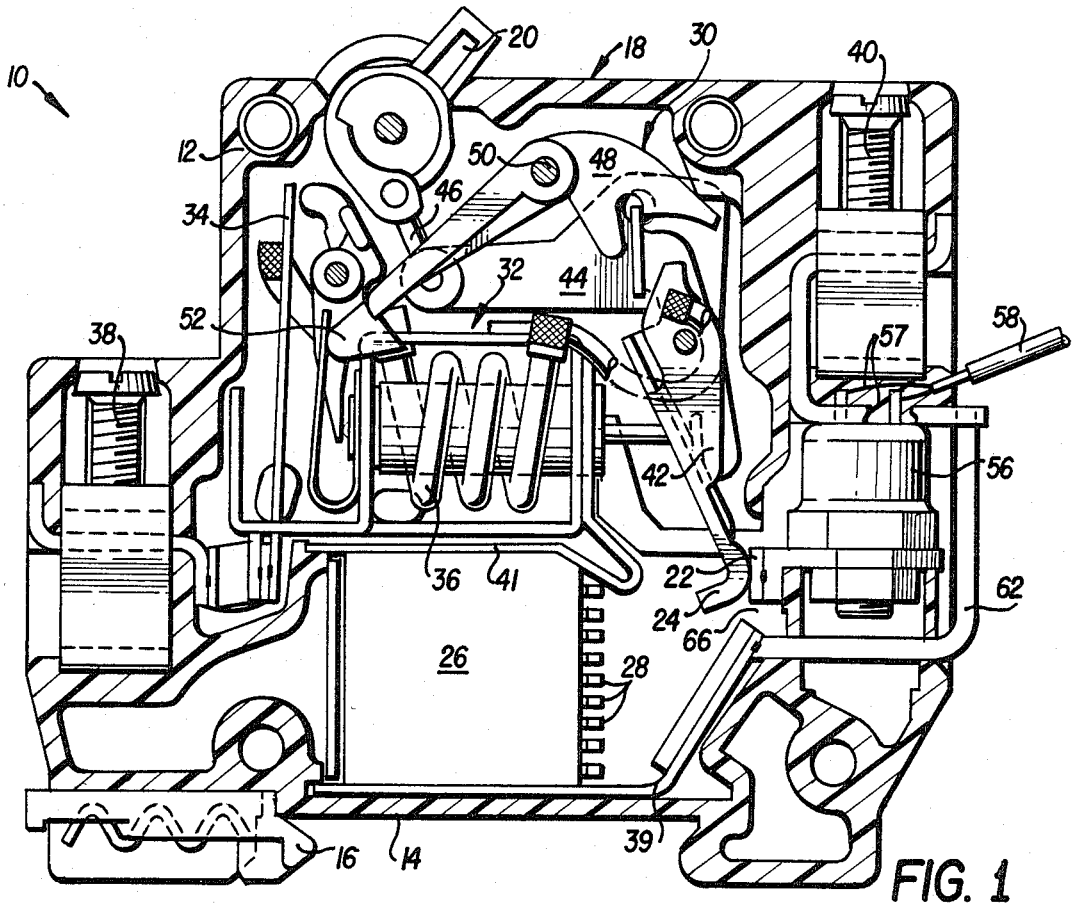
FIG. 1 is a vertical sectional view of a pole of magnetothermal circuit breaker equipped with a remotely controlled switch according to the invention, the pole contacts being in a switch-on position.
Figure 2:
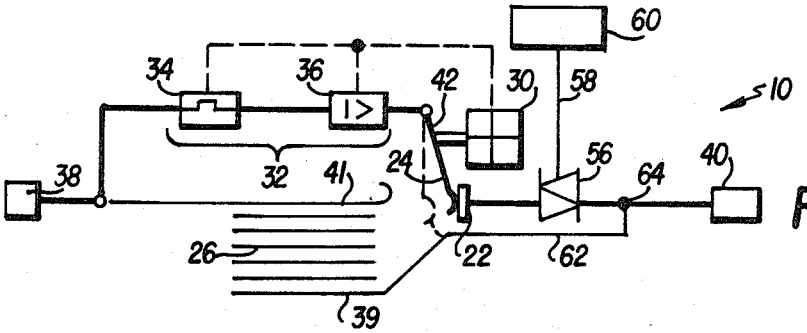
FIG. 2 is a schematic view of the circuit breaker of FIG. 1.

On FIGS. 1 and 2, a pole of a miniature electric circuit breaker 10 used in a low voltage alternating net system is represented. The casing 12 is a molded insulating material including bottom base 14 fitted to a support rail by means of a latch 16, and a front side 18 provided with an opening for the passage of a control handle 20. Each pole comprises a pair of separating contacts 22,24, a cut-off or arc extinguishing chamber 26 with plate-sheets 28 to de-ionize the arc, and an operation mechanism 30 associated with the manual control handle 20 and with a magnetothermal trip or release 32. The latter is electrically inserted in the main tripping circuit and is formed by a thermal release with bimetal strip 34 and an electromagnetic release with coil 36 connected in series with the pair of contacts 22, 24 which are electrically bound with the connecting terminals 38, 40 of the pole. The cut-off chamber 26 is enclosed by two lower 39 and upper 41 arcing horns extending parallel to the plate-sheets 28 and to the base bottom 14.

The moving contact 24 is linked together with a contact arm 42 driven by the operation mechanism 30. The contact arm 42 is rotatably mounted on a tumbler 44 mechanically coupled to a toggle 46 associated with the handle 20. A tripping lever 48 rotating on an axis 50 cooperates with the end of the contact arm 42 opposite to the moving contact 24, so as to secure the arm 42 to the tumbler 44. A latch 52 assures the hooking of the tripping lever 48 in latching position. The automatic opening of the contacts 22, 24 of the pole is induced by rotation of the latch 52 toward an unlatched position which releases the tripping lever 48 driving the contact arm 42 rotating toward the switch-off position under the action of a spring. The latch 52 is driven toward the unlatched position either by the deflection of the bimetal strip 34 in case of overload, or by the shift of the moving core of the electromagnetic release 36 when a short-circuit appears. The performance of such a circuit breaker is well known to those skilled in the art and is described inside French Pat. No. 2.468.202 or U.S. Pat. No. 4,222,019 the disclosure of which is herein incorporated by reference and can be referred to for more details.

According to the invention, a static switching member formed by a controlled semi-conductor element (in particular a triac 56 or two thyristors in parallel head to tail) is electrically connected in the main circuit, in series with the pair of contacts 22, 24 and the releases with bimetal strip 34 and electromagnetic coil 36. The gate electrode of the triac 56 is connected to a connection plug 57 disposed inside the casing 12 and able to receive an outside conductor 58 in conjunction with a remote control device 60 (FIG. 2).

Referring to FIGS. 1 and 2, the triac 56 is electrically connected in the main circuit between the fixed contact 22 and one of the pole connecting terminals 40. The moving contact 24 is electrically connected to the other terminal 38 through the coil 36 and the bimetal strip 34. In switch-on position of the contacts 22, 24, the rated current in the main circuit flows through the triac 56 in conductive state, the coil 36 of the electromagnetic release and the bimetal strip 34 of the thermal release. The upper arcing horn 41 is connected to the bottom of the bimetal strip 34 bound to the terminal 38. The lower arcing horn 39 is extended into the vicinity of the fixed contact 22 and is connected by a connection conductor 62 to a connecting point 64 located between the triac 56 and the terminal 40 of the main circuit. The arcing horn 39 is separated from the fixed contact 22 by a small gap 66 so as to allow the rapid switch of the arc on the extension of the lower horn 39 from the beginning of the opening travel of the contact arm 42.

The operation of the magnetothermal circuit breaker 10 with remote control according to FIGS. 1 and 2 is described as follows:

Under normal performance of monitoring the circuit breaker, the triac 56 is conducting and the contacts 22, 24 are found in switch-on position. The pole current flows through the main circuit comprising the bimetal strip 34, the coil 36 and the triac 56.

When an overload current appears the deflection of the bimetal strip 34 occurs to induce the unlocking of the latch 52 after the threshold of the thermal tripping is exceeded. The operation mechanism 30 ensures the shift of the contact arm 42 toward the switch-off position in a well known way. The same holds true when the fault current is a short-circuit which activates the electromagnetic release 36 when the instantaneous tripping threshold is exceeded. The conducting triac 56 is short-circuited by the conductor 62 as soon as the arc switches over on the lower horn 39 at the beginning of the opening travel of the moving contact 24 (in dotted lines in FIGS. 2 and 3). The triac 56 is thus protected against any over-current as soon as the contacts 22, 24 are separated and is automatically turned off at the next zero passage of the current. At the end of the opening travel of the contact arm 42 the usual switch of the arc on the upper horn 41 occurs, the arc being then anchored between the two horns 39, 41 of the chamber 26, so as to shunt the bimetal strip 34 and the coil 36 of the thermal and electromagnetic releases. Arc suppression is operated in the chamber 26 due to the de-ionization plate-sheets 28.

In the absence of fault on the net system the switch-off and on of the circuit breaker connected to the net system is carried out according to two separate ways:

either by manual action of the control handle 20 of the mechanism 30 which mechanically drives the contact arm 42 toward the switch-off or on position. The circuit breaker 10 operates then as a mechanical switch capable of creating and interrupting the rated current of the pole;

or by remote control of triac 56 by means of the device 60, the handle 20 of the mechanism 30 and the contacts 22, 24 remaining still in switch-on position.

The circuit breaker 10 then operates as remotely controlled static switch by locking and unlocking the triac 56 ensuring the breaking and creation of the rated current respectively in the main circuit of the pole without activating the circuit breaker mechanism 30.

It is noticed that the function of protecting against the over-currents is assured by the magnetothermal release 32 cooperating with the mechanism 30 to open the contact arm 42, the triac 56 being in conducting state. The switching of the arc on the horn 39 short-circuits the triac 56 which is switched off, the latter being protected against the fault current as soon as the contacts 22, 24 separate from each other. The function of remote control of the circuit breaker 10 results from the device 60 of remote control of the triac 56 while the mechanism 30 remains inactive in switch-on position of the contacts 22, 24.

Figure 3:
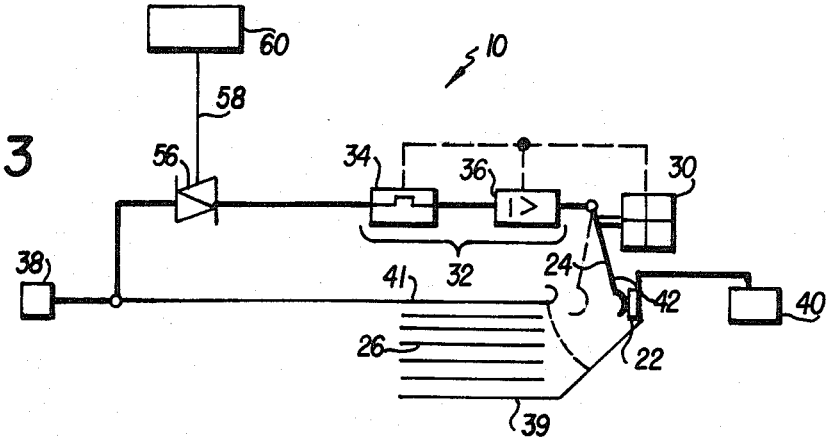
FIG. 3 is a view similar to FIG. 2 of another embodiment of the inventive circuit breaker.

The variant of FIG. 3 shows a different electrical connection of the triac 56 in the main tripping circuit of the pole. All the other elements of the circuit breaker 10 are identical to the one of FIGS. 1 and 2, except the lower horn 39 is directly connected to the fixed contact 22. The triac 56 is inserted between the moving contact 24 and the terminal 38 in series with the bimetal strip 34 and the coil 36 of the magnetothermal release 32. The fixed contact 22 is directly connected to the terminal 40.

The performance of the remotely controlled circuit breaker 10 according to FIG. 3 is similar to the one of FIGS. 1 and 2, the shunting time of the triac 56 during the disconnection period is only modified. The shunting occurs at the end of opening travel of the contact arm 42 (in dotted lines in FIG. 3) when the arc is switched on the upper horn 41. The series circuit formed by the triac 56, the bimetal strip 34 and the coil 36 is then short-circuited by the upper horn 41.

An auxiliary switch (e.g., an electromechanical switch such as a contactor or teleruptor) may be substituted for the triac 56 and connected in series with the main circuit of the circuit breaker. The auxiliary switch operates in a manner similar to that of FIG. 3 with the shunt circuit causing a bypass of the series circuit. Such a switch may be located in a separate enclosure or within the same casing for the main circuit.

I claim:

1. An electric circuit breaker comprising:

a pair of cooperating separable contacts;

an operating mechanism for moving said contacts between open and closed positions;

a trip device automatically actuated to a tripped position when an overload current exceeds a predetermined threshold current, said trip device cooperating with said operating mechanism for moving said contacts to the open position;

a static switch comprising a controlled rectifier device, said controlled rectifier device being a member of the group of a triac and two reversely connected thyristors, said switch being electrically connected in series with said separable contacts, and being rated for carrying and breaking a nominal load current;

a shunt circuit for bypassing said static switch upon the occurrence of said overload current; and control means for rendering said shunt circuit conductive when an arc is drawn between said separable contacts.

2. The electric circuit breaker according to claim 1, wherein said control means includes a guiding horn disposed adjacent to one of the contacts.

3. The electric circuit breaker according to claim 1, further comprising:

a molded casing of insulating material having a pair of first and second terminals;

a main circuit connecting said terminals to said contacts, said shunt circuit being inserted in parllel with said main circuit;

a thermal and electromagnetic trip device electrically connected in series with said static switch and said contacts; and an arc extinguishing chamber including a pair of first and second guiding horns for guiding the arc towards said chamber, thereby rendering said shunt circuit conductive as soon as the arc is switched onto the guilding horns.

4. The electric circuit breaker according to claim 3, wherein the static switch is electrically connected between a fixed contact and the associated first terminal, said first guiding horn being separated from the fixed contact by a small gap and being connected to a connecting point located between the static switch and said first terminal.

5. The electric circuit breaker according to claim 3, wherein the static switch is connected in series in the main circuit, the trip device being located between a movable contact and the associated second terminal, said second guiding horn being connected to the second terminal and said first guiding horn being connected to the fixed contact and to the first terminal.

6. The electric circuit breaker according to claim 3, including a remote controlled static switch having:

a connection plug located in the casing for receiving an external connection conductor; and a control electrode of the controlled rectifier device electrically connected to said plug.

7. An electric circuit breaker comprising:

a pair of cooperating separable contacts;

an operating mechanism for moving said contacts between open and closed positions;

a thermal and magnetic trip device automatically actuated to a tripped position when an overload current exceeds a predetermined threshold current, and cooperating with said operating mechanism for moving said contacts to the open position;

a molded casing of insulating material having a pair of first and second terminals;

a main circuit connecting said terminals to said contacts via said trip device;

an auxiliary switch being rated for carrying and breaking a nominal load current, said switch being electrically connected in series in the main circuit with said contacts; and a shunt circuit connected in parallel with said main circuit for bypassing said switch upon the occurrence of an arc between said separable contacts.

* * * * *